United States Patent [19]

Murphy

[11] 4,054,410

[45] Oct. 18, 1977

[54] FUSING DEVICE

[75] Inventor: Richard J. Murphy, Norwood, Mass.

[73] Assignee: Xerox Corporation, Stamford, Conn.

[21] Appl. No.: 682,944

[22] Filed: May 3, 1976

Related U.S. Application Data

[62] Division of Ser. No. 497,410, Aug. 14, 1974, Pat. No. 3,976,814.

[51] Int. Cl.[2] ..... F27B 9/28; G03G 21/00

[52] U.S. Cl. ..... 432/60; 118/60

[58] Field of Search ..... 118/60, 70, 104, 203; 432/60, 228; 428/447; 29/132; 427/22, 387

[56] References Cited

U.S. PATENT DOCUMENTS

| | | | |
|---|---|---|---|
| 2,125,336 | 8/1938 | Ettl | 118/203 |
| 3,455,732 | 7/1969 | Hathaway, Jr. | 428/447 |
| 3,731,358 | 5/1973 | Artl | 29/132 |
| 3,796,183 | 3/1974 | Thettu | 432/60 X |
| 3,880,577 | 4/1975 | Tomoto et al. | 432/228 |
| 3,908,589 | 9/1975 | Bar-on | 118/60 |
| 3,964,431 | 6/1976 | Namiki | 118/60 |

*Primary Examiner*—Dorsey Newton

*Attorney, Agent, or Firm*—James J. Ralabate; Ernest F. Chapman

[57] ABSTRACT

A device is disclosed for supplying water or moisture to the surfaces of fuser members comprising water-degradable silicone rubbers. The water or moisture produces a degradation product of the silicone rubber which is a release material for electroscopic resin toners used in xerographic copiers.

6 Claims, 9 Drawing Figures

FUSING DEVICE

This is a division of application Ser. No. 497,410, filed Aug. 14, 1974, now U.S. Pat. No. 3,976,814.

BACKGROUND OF THE INVENTION

This invention relates generally to heat fusing methods and devices, and more particularly, to an improved fusing surface and method which will prevent offseting of a resin-based powder onto the surface during the fusing operation. As used herein, the fusing surface may be a roll, a flat surface or any other shape suitable for fixing toner or resin-based powder images. The invention is particularly useful in the field of xerography where images are electrostatically formed and developed with resinous powders known as toners, and there-after fused or fixed onto sheets of paper or other substrates to which the powder images have been transferred. The resin-based powders or toners of this invention are heat softenable, such as those provided by toners which contain thermoplastic resins and used conventionally in a variety of commercially known methods.

In order to fuse images formed of the resinous powders or toners, it is necessary to heat the powder and the substrate to which it is to be fused to a relatively high temperature, generally in excess of about 200° F. This will vary depending upon the softening range of the particular resin used in the toner. Generally, even higher temperatures are contemplated such as approximately 325° F., or higher. It is undesirable, however, to raise the temperature of the substrate substantially higher than 400° F., because of the tendency of the substrate to discolor at such elevated temperatures, particularly when the substrate is paper.

It has long been recognized that one of the fastest and most positive methods of applying heat for fusing the powder image is direct contact of the resin-based powder with a hot surface, such as a heated roll. But, in most instances as the powder image is tackified by heat, part of the image carried by the support material will stick to the surface of the plate or roll so that as the next sheet is advanced on the heated roll, the tackified image, partially removed from the first sheet, will partly transfer to the next sheet and at the same time part of the tackified image from said next sheet would adhere to the heated roll. This process is commonly referred to in the art as "offset", a term now well-known in the art.

The offset of toner onto the heated surface led to the development of improved methods and apparatus for fusing the toner image. These improvements comprised fusing toner images by forwarding the sheet or web of substrate materil bearing the image between two rolls at least one of which was heated, the rolls contacting the image being provided with a thin coating of tetrafluoroethylene resin and a silicone oil film to prevent toner offset. The outer surfaces of such rolls have also been fabricated of fluorinated ethylene/propylene or silicone elastomers coated with silicone oil as well as silicone elastomers containing low surface energy fillers such as fluorinated organic polymers, and the like. The tendency of these rolls to pick up the toner generally requires some type of release fluid continuously applied through the surface of the roll to prevent such offset, and commonly known silicone oils, are generally well adapted for this purpose.

In copending patent applications filed herewith, there are described fuser members and surfaces wherein a release fluid is inherently supplied on the surfaces thereof as a result of the degradation of the water-degradable silicone rubber on the surfaces of the fusing members. In one case, the silicone rubber degrades to a degradation product which is a release material for toners by the reaction between the water-degradable silicone rubber and water supplied by an agent incorporated in the rubber. In another case, the degradation of the water-degradable silicone rubber is promoted by a catalytic agent in the presence of water. It is principal object of this invention to provide a device and method for supplying water external of the fuser member to provide sufficient moisture for the degradation of the water-degradable silicone rubber.

It is another object of this invention to provide a fusing surface and method for rapidly fixing resinous powder images without causing offset.

Another object of the present invention is to provide a silicone rubber fuser surface which makes physical contact with the resinous powder image on the substrate, and which, without the use of a release fluid applicator, provides a layer of release material on the surface of the silicone rubber, thereby preventing offset images thereon.

SUMMARY OF THE INVENTION

These and other objects of the invention are obtained by providing means for applying water or moisture to the surface of a fuser member comprising a water-degradable silicone rubber. As used herein, water and moisture include water in all of its physical states and may be used interchangeably. In accordance with the present invention there is provided a fusing device comprising a working surface of water-degradable silicone rubber, means for heating the working surface and means for providing a source of moisture external the working surface.

Means for providing a source of moisture external the water-degradable working surface of the fusing member or device include a water reservoir for immersing at least a part of the fuser member in water contained therein; a roll applicator in contact with the fuser member and a source of water such as an internal source supplied to the exterior thereof through ports or jets or other similar orifices or external sources such as a reservoir, pad, wick, brush, sprinkler system and the like; a wick applicator in contact with the fuser member; water nozzles or steam jet applicators proximate the fuser member and supplying moisture directly thereon; a moisture or humidity chamber proximate at least part of the fuser member; a sprinkler system proximate the fuser member; a sponge, sponge-like, or other absorbent material applicator in contact with the fuser member; an absorbent pad in contact with the fuser member; wet or moisture laden brushes in contact with the fuser member; a web applicator in contact with the fuser member; and a moisture chamber for maintaining moisture in the paper or other substrate upon which toner images are fused or other similar means for maintaining the moisture content of the paper at a suitable level.

In accordance with the present invention, there is also provided a fuser member for use in a xerographic reproducing apparatus for fixing a resin-based powder image to a substrate at elevated temperatures, said fuser member having a surface comprising a water-degradable silicone rubber or elastomer. The water-degradable silicone rubber may also comprise conventional fillers, catalytic agents to promote the degradation of the silicone rubber in the presence of moisture and/or agents capable of supplying water internally, that is, incorporated in the silicone rubber.

There is also provided a method of fixing a resin-based powder image to a substrate comprising contacting a substrate bearing a resin-based powder image with the heated surface of a silicone rubber layer for a time and at a temperature sufficient to permit the fusion of the resin-based powder to the substrate, the silicone rubber layer being the type which is degradable in the presence of moisture to form a degradation product on the heated surface, said degradation product having an adhesion for the fused resin-based powder which is less than the adhesion which the fused resin-based powder has for the substrate; providing a source of moisture at the surface of the water-degradable silicone rubber; separating the substrate from the heated surface whereby the fused resin-based powder is retained on the substrate; and permitting the fused resin-based powder on the substrate to cool.

The surface of the water-degradable silicone rubber layer is adhesive to the tackified resin-based powder undergoing fusion on the substrate because the silicone rubber layer in the presence of water or moisture degrades thereby forming a degradation product which is a release material for the tackified resin powder on the heated surface. This degradation product has an adhesion for the fused resin-based powder which is less than the adhesion which the fused resin-based powder has for the substrate, thus, the heated surface of the silicone rubber layer is abhesive to the tackified or heated resin-based powder, and offset is prevented on the heated surface of the water-degradable silicone rubber layer.

The degradation product of the silicone rubber resulting from the reaction of the silicone rubber with water provides a release material on the surface of the silicone rubber layer. The degradation product of the water-degradable silicone rubber is a lower molecular weight silicone material having a low surface energy, and it is preferably fluid in nature and resembles silicone oil in properties.

The invention permits the generation of the degradation product of the water-degradable silicone rubber layer at operating temperatures, that is, at the temperatures which resin-based powder or toner tackifies. The scission process in silicone rubbers is known in the art and is described by Thomas in "Rubber Chemistry and Technology", 40 269 (1967). Therein, it is disclosed that a peroxide-cured methyl vinyl silicone rubber degrades in the presence of water. In accordance with the present invention, water or moisture supplied to the surface of the water-degradable silicone rubber layer on the fuser member provides sufficient degradation product of the silicone rubber to form a release layer on the surface of the silicone rubber layer. Thus, by providing a supply of water or moisture by the described means, there is provided a method of continuously generating the degradation product to coat the surface of the silicone rubber layer and provide on the surface thereof a layer of degradation product adhesive to the resin-based powder toner throughout the lifetime of the silicone rubber layer.

Other objects and advantages of the present invention will become apparent when read in conjunction with the accompanying drawings.

DESCRIPTION OF THE PREFERRED EMBODIMENTS

Figure 1:
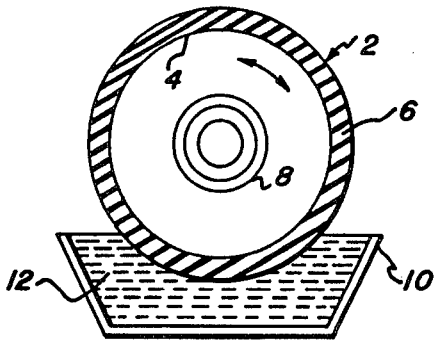
FIG. 1 is a side elevational view of a fuser roll and a reservoir water supply means therefor.

In accordance with the present invention, the surface for fixing or fusing a resin-based powder image to a substrate at elevated temperatures may be either a roll, a flat surface, or another type of suitable configuration. However, in accordance with the present invention, the surface must have at least a water-degradable silicone rubber or elastomer layer which coats the surface exposed to the resin-based powder image. Although the invention is applicable to almost any type of surface which may be used in fixing or fusing a resin-based powder image, for convenience, descriptions set forth herein are directed to fuser roll members which are substantially cylindrical in shape.

The fuser roll members may be constructed entirely of silicone rubber or elastomer, however, in the preferred embodiments herein, the roll structure comprises a hollow cylindrical metal core such as copper, aluminum, steel and the like or coated layers of copper, steel and aluminum and the like, overcoated with the layer of the water-degradable silicone rubber, which in the presence of water or moisture, degrades to a degradation product which is adhesive to resin-based powder or toners. As used herein, resin-based powders and toner are used synonymously.

Degradation product herein refers to the product resulting from the degradation of water-degradable silicone rubber or elastomer in accordance with the present invention when the silicone rubber or elastomer is heated at operating temperatures of the fusing or fixing station, and in the presence of water or moisture a product having a lower molecular weight and a more fluid state as well as a lower surface energy than the silicone rubber or elastomer is formed. Preferably, the degradation product is in the nature of an oil. The degradation product forms or accumulates as a layer on the silicone rubber surface. Thus, it is believed that the degratation product is the reaction product of the silicone elastomer or rubber with water at elevated temperatures, for example, from 200°. to about 440° F., and that is is a hydrolysis reaction of silicone rubber shown by the formula (crosslinking omitted) set forth below:

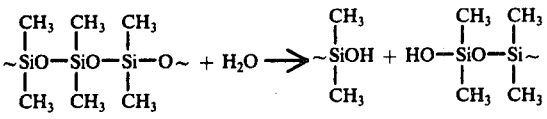

The reaction is believed to take place by the breaking of the polysiloxane backbone chain with the resultant formation of hydroxyl groups where the chain scission occurs. Infrared spectra studies have shown the presence of hydroxyl (—OH) groups after the reaction has occurred.

The surfaces of the fusing devices of the present invention are preferably prepared by applying either in one application or by successively applying to the surface to be coated with the silicone rubber layer a thin coating or coatings of the water-degradable silicone rubber. When successive applications are made to the surface to be coated, it is generally necessary to heat the film-coated surface to a temperature sufficient to flash off any solvent contained in the film. For example, when a fuser roll is coated with a water-degradable silicone rubber layer, the silicone rubber compound dissolved in a solvent or dispersed in a fluid medium, and the like, is successively applied to the roll in thin coatings, and between each application, heating of the film-coated roll is carried out at temperatures of at least about 200° F., or higher so as to flash off most of the solvent contained in the film. When the desired thickness of coating is obtained, the coating is fused to the roll surface. The water-degradable silicone rubber may also be applied as a sleeve to a roll or as a mat to flat or other suitable surfaces. Conventional methods known in the art may be used in providing a surface in accordance with this invention, and the method for coating rollers are taught by Aser et al in U.S. Pat. No. 3,435,500 may be used. Another convenient way of forming a fuser roll is by providing an outer layer of the water-degradable silicone rubber wound onto a central core into which core a heating element can be inserted for internally heating the roll.

There are many variables which must be taken into consideration in order to provide the most effective fusing operation, and these include such variables as hardness of the fusing surface, thermal conductivity, pressure, roll or contact speed, heat input, and the like. The selection and balancing of these variables is well-known in the art and may effect the selection of the particular water-degradable silicone rubber which is to be utilized for the particular fixing surface and for the particular mode of supplying water or moisture to the surface of the fuser member. Although the thickness of the water-degradable silicone rubber layer may vary with different specific applications of fusing, and particularly of pressure fusing at elevated temperatures, it is generally preferred that the thickness of the water-degradable silicone rubber be at least about 0.5 mil. More preferred embodiments however, comprise silicone rubber layers which are about 4 to about 10 mils in thickness in order to provide surfaces which are deformable. However, where deformable or compressible surfaces are not required, and the lack of compressibility is not critical, the thickness of the silicone elastomer may be lower than 4 mils, or alternatively, the thickness of the silicone elastomer may be lower than 4.0 mils when a compressible surface is desired, and there is an undercoating to provide the desired compressibility.

Any type of silicone rubber, gum or elastomer which is capable of undergoing degradation in the presence of water or moisture, may be suitable in the practice of the present invention, especially silicone rubbers which undergo degradation at temperatures used in the fusing operation, for example, about 200° to about 400° F. Satisfactory water-degradable silicone rubbers include vulcanized polymethylvinyl siloxane, for example, the Dow Corning 400 series of silicone rubbers, polymethylphenyl siloxane, poly-dialkyl siloxane, fluorinated siloxane rubbers or gums, silicone rubber copolymers such as those having block, random, or graft configuration and the like. Vinyl dimethyl polysiloxane, vinyl phenyl polysiloxane, and methyl trifluoropropyl and vinyl dimethyl polysiloxanes are also examples of silicone elastomers or rubbers which can be used in accordance with the present invention and which degrade to form lower molecular weight fluids upon the hydrolysis reaction in the presence of moisture or water. The only limiting factor in the type of silicone elastomer, gum or rubber which may be utilized in accordance with the present invention, is that it must be capable of forming a degradation product in the presence of water or moisture at elevated temperatures, the degradation product being capable of acting as a release material for tackified resin-based powder or toner placed thereon.

The amount of water or moisture applied to the fuser member must be an amount sufficient to cause the degradation of the water degradable silicone rubber on the surface of the member. Although the amount of moisture or water required to cause the degradation of the water degradable silicone rubber is dependent upon several variables including the type of rubber, the rate of contact with the substrate (for example, nip speed in those embodiments having a backup roll), the nip pressure, the fusing temperature and the like. Generally the atmosphere surrounding the fuser member or the substrate bearing the toner image to be fused must have a moisture content equivalent to about a relatively humidity of 80 percent or higher. In certain preferred embodiments the moisture provided at the surface of the fuser member is a layer of water or steam as seen in the accompanying drawings.

The moisture or water may be applied to the fuser member surface having water-degradable silicone rubber thereon in any mode which will provide sufficient moisture to cause the formation or degradation products thereon which are operable as release materials to resinous toners commonly used in xerography. In FIG. 1, there is shown fuser roll member 2 having a water-degradable silicone rubber material 6 on cylindrical core 4 which is preferably a metal cylinder. Heating means 8, preferably a quartz lamp, is provided at the core of fuser member 2 is provide heat at the fusing surface. Fuser roll 2 extends into reservoir 10 which is constructed to retain water shown by numeral 12 so that as the fuser member rotates, it passes into the water held in reservoir 10 and provides the moisture for the formation of the degradation product on the surface of fuser 2. In all embodiments where water is used, it is preferred that the water be maintained at high temperatures so that there is as little heat loss as possible from the fusing surface. Further, it is preferred that there is minimal contact between the surface of fuser member 2 and the water source or water supplying means to prevent loss of heat and excessive degradation.

Figure 2:
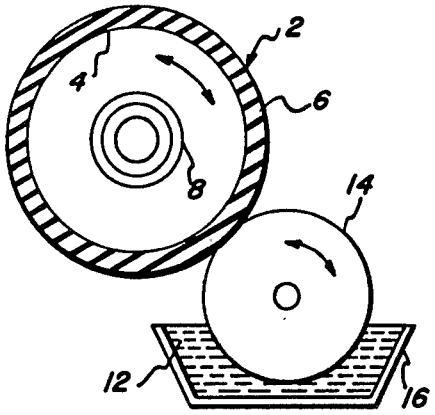
FIG. 2 is a side elevational view showing roll applicator means for providing a source of moisture at the surface of a fuser member.

In FIG. 2, moisture is provided at the surface of fuser member 2 having a water-degradable silicone rubber layer 6 on cylinder 4 by applicator roll 14. Applicator roll 14 may be of any suitable construction including metallic, polymeric and the like which will convey water to the surface of fuser member 2, however, the material is preferably of a type which will not decopose, oxidize or deform at the operating temperatures of the fuser member. In the embodiment shown, water is applied to applicator roll 14 from reservoir 16, however, water may be applied to applicator roll 14 by any suitable means including wiping, padding, spraying and the like (not shown). The water designated by numeral 12 applied to the surface of the water degradable silicone rubber 6 causes the degradation of the silicone rubber at elevated temperatures in accordance with the present invention. Although it is not shown, applicator 14 may be internally supplied by water which is directed to the external surface thereof by suitable channels, orifices and the like.

Figure 3:
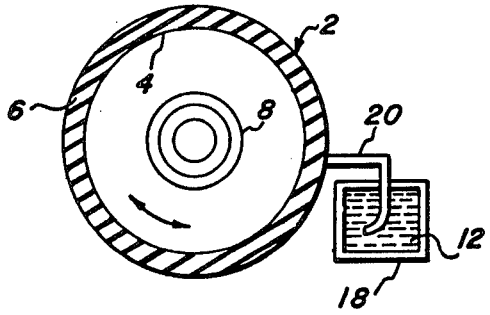
FIG. 3 is a side elevational view showing wick means for applying moisture to the surface of a fuser member.

In all figures, the numberals used to describe the fuser member are the same, and the moisture is designated by the same numeral throughout all figures. In FIG. 3, the means for supplying water to the surface of fuser member 2 is wick 20 extending into reservoir 18 containing water 12. Other means (not shown) may be used to maintain moisture on wick 20, for example, spraying means. Wick 20 must be of any suitable material which will convey the water to the surface of the fuser member without deteriorating at the operating temperatures of the fuser member.

Figure 4:
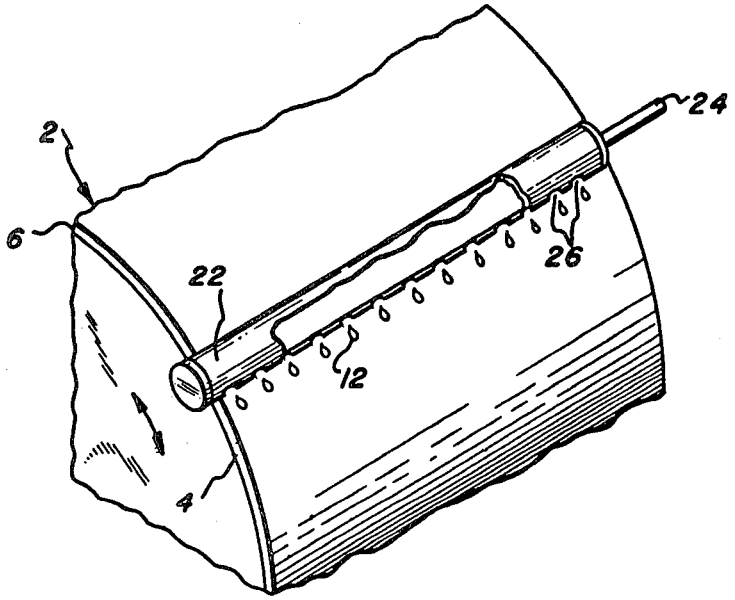
FIG. 4 is a cut-away view showing water or steam jet applicator means for providing a source of moisture at the surface of a fuser member.

FIG. 4 shows the application of moisture represented by water droplets 12 pasing from an apertured tube or pipe 22 and falling upon the surface of fuser member 2 to provide water at the surface of fuser 2 and thereby cause the degradation of water-degradable silicone rubber layer 6 at elevated temperatures. A nozzle or jet or a plurality thereof may also be provided (not shown) to spray the water or steam upon the surface to be degraded. The embodiment shown in FIG. 4 is in the form of a sprinkler-type system. Water may be supplied to tube 22 through port 24.

Figure 5:
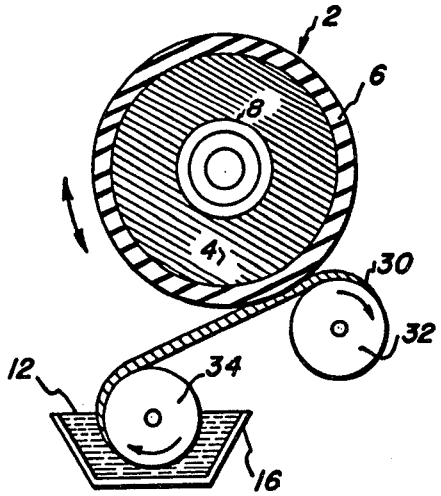
FIG. 5 is a side elevational view showing web applicator means for applying moisture to the surface of a fuser member.

A web 30 as shown in FIG. 5 may also be used to supply moisture to the surface of fuser member 2. In the embodiment shown, web 30 advances from reel 34 in reservoir 16 containing water 12 to reel 32 and is in contact with fuser member surface 2. Water retained by web 30 is supplied to fuser 2 at the point of contact therewith. Web 32 must be made of materials which do not decompose at the operating temperatures of fuser member 2.

Figure 6:
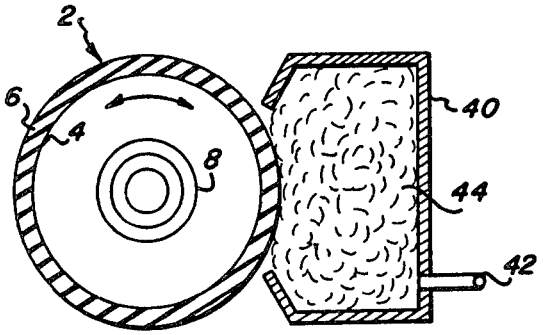
FIG. 6 is a side elevational view of a fuser roll extending into a humidity chamber.
Figure 9:
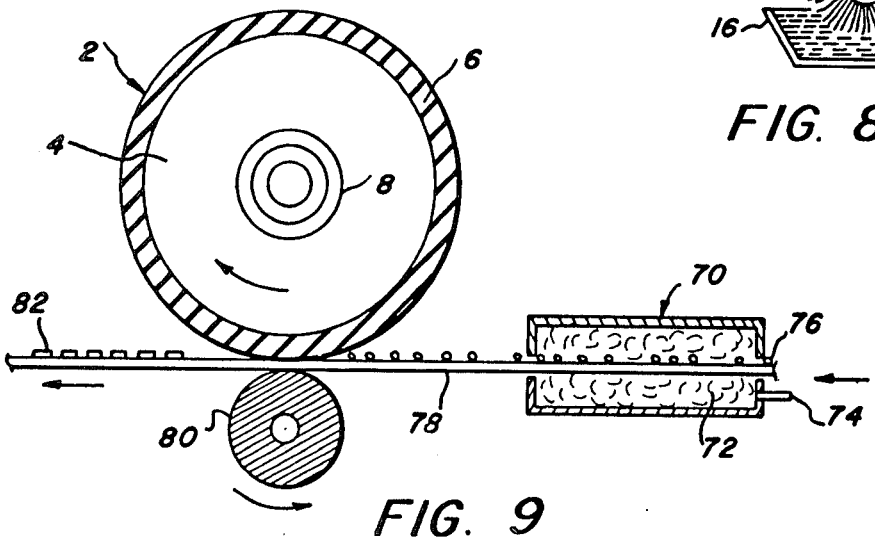
FIG. 9 is a side elevational view of a fuser roll showing a humidity chamber through which the substrate travels prior to contact of the fuser member therewith.

Fuser member 2 in FIG. 6 is shown extending into humidity chamber 40 where moisture is supplied to water-degradable silicone rubber 6 as it passes therethrough. Moisture is designated as 44 in the drawing and may be supplied to the chamber through port 42. A reservoir of water (not shown) may be maintained in humidity chamber 40 to provide the moisture for the degradation of the silicone rubber. Moisture chamber 40 may be built so that it substantially encompasses the entire fuser member (not shown). Moisture chamber 70 is shown in FIG. 9 as supplying moisture to the substrate 78, such as paper, having an unfused toner image, 76 thereon. The moisture imparted to the substrate 76 while passing through the chamber 70 provides a supply of moisture at the surface of fuser member 2 to cause the degradation of water-degradable silicone rubber 6. A conventional backup roll 80 is shown in FIG. 9 as forming a nip with fuser member 2. The fused toner is designated by numeral 82.

Figure 7:
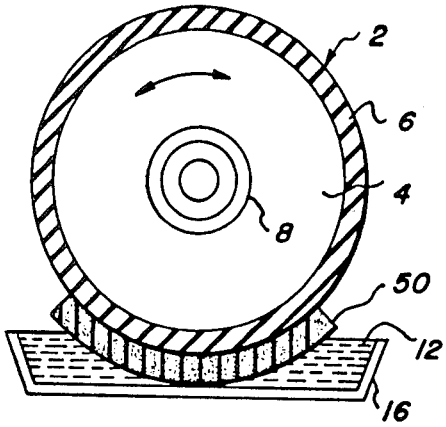
FIG. 7 is a side elevational view of a fuser roll having padding means for applying moisture to the surface of the fuser member.

FIG. 7 shows porous pad 50 capable of retaining water in contact with fuser member 2 to provide moisture at the surface of the fuser member 2 thereby causing the degradation of the silicone rubber 6 at elevated temperatures. A reservoir 16 is shown as providing a supply of water to pad 50. Other suitable means (not shown) may be used to moisten pad 50. Pad 50, in contact with roll 2, must be made of material which will not decompose or deteriorate at operating temperatures.

Figure 8:
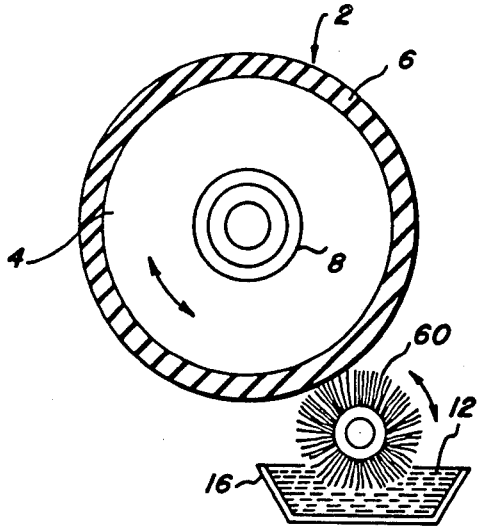
FIG. 8 is a side elevational view of a fuser roll having brushes in contact with the fuser roll to supply moisture thereto.

In FIG. 8, there is shown a rotatable brush 60 adjacent fuser member 2 to provide a supply of water sufficient to degrade water-degradable silicone rubber 6. As shown, brush 60 is supplied by moisture from reservoir 16, however, other modes such as spraying, may be used to moisten brush 60. Brush 60 must be made of materials which can withstand the heat produced by fuser member 2.

In all drawings, rotation of members is shown by arrows.

In accordance with the present invention, the water-degradable silicone rubbers may comprise catalytic agents as described in my copending application filed herewith and incorporated herein by reference. The catalytic agent, for example benzoic acid, is incorporated in the silicone rubber and in the presence of moisture, the catalytic agent promotes the degradation of the silicone rubber. The claims thereof are directed to a surface for use in a xerographic reproducing apparatus for fixing a resin-based powder image to a substrate at elevated temperatures, said surface comprising silicone rubber having a catalytic agent which is the presence of water or moisture, promotes the degradation of the silicone rubber.

The water degradable silicone rubbers may also comprise conventional fillers such a strengthening agents as well as agents which internally supply moisture to the water-degradable silicone rubber as set forth in my copending patent application filed herewith incorporated herein by reference. Dispersed or otherwise distributed in the water degradable silicone rubber is an agent capable of supplying water over a period of time at elevated temperatures. The claims thereof are directed to a surface for use in a xerographic reproducing apparatus for fixing a resin-based powder image to a substrate at elevated temperatures, said surface comprising silicone rubber having an agent capable of supplying water dispersed therein. The water may be supplied by fillers which act a absorbents or reservoirs for water such as colloidal silica gel; by agents which decompose to form water; by encapsulated water; or by agents which react to form water.

The moisture or water supplied to the water-degradable silicone rubber at elevated temperatures, for example, about 200° F., to about 440° F., will result in the thermal degradation of the silicone rubber to produce the degradation product which acts as a release agent for the tackified resin-based powder or toner on the surface of the fuser member. The degradation of the water-degradable silicone rubber at elevated temperatures preferably takes place at a rate which will extend over a period of time and thereby increase the release life of the roll or other suitable fixing surface without the external application of other release materials.

As indicated supra, the moisture or water, regardless of the technique used to supply it to the silicone rubber, must be present in an amount which provides sufficient water to cause the degradation of the silicone rubber and the formation of the silicone rubber degradation product.

Although the invention has been described mainly in terms of silicone rubber layers or coatings upon rolls which are conductive to heat, the present invention is not limited to such a configuration and preferred embodiments of the invention also encompass flat silicone rubber surfaces, concave or convex surfaces of silicone rubber and all other configurations which may be used in fusing operations and devices. Furthermore, the present invention may be directed to any surface which requires a silicone rubber layer having a release layer thereon, and is not necessarily directed to fuser rolls or fuser surfaces.

The invention is also directed to a process for providing or continuously generating a release agent on the surface of a water-degradable silicone rubber fuser member which comprises providing a silicone rubber material capable forming a degradation product or reversion product in the presence of moisture or water at elevated temperatures, providing a source of water at the surface of the silicone rubber layer and heating the silicone rubber layer at the temperature which causes the formation of a degradation product which coats the silicone rubber layer, thereby providing a release material on the surface. This release material is preferably a silicone fluid.

It is to be understood that the above description is for the purpose of illustration only, and that the invention includes all modifications falling within the scope of the appended claims.

What is claimed is:

1. A fusing device for use in a xerographic reproducing apparatus for fixing a resin-based powder image to a substrate comprising a fusing member having a water-degradable silicone rubber outer surface; means for heating the outer surface of the fuser member to form thereon a degradation product in the presence of water; means for applying water to the surface of the fuser member; and means for contacting the heated fuser member with a substrate having a resin-based powder thereon.

2. The fusing device of claim 1 wherein the means for applying water to the water-degradable surface of the fuser member is a wick applicator in contact with the fuser member surface and a source of water.

3. The fusing device of claim 1 wherein the means for applying water to the water-degradable surface of the fuser member is at least one water spraying device proximate the fuser member surface.

4. The fusing device of claim 1 wherein the means for applying water to the water-degradable surface of the fuser member is a humidity chamber proximate at least part of the surface of the fuser member.

5. The fusing device of claim 1 wherein the means for applying water to the water-degradable surface of the fuser member is a pad in contact with the fuser member and a source of water.

6. The fusing device of claim 1 wherein the means for applying water to the water-degradable surface of the fuser member is a brush in contact with the fuser member and a source of water.

* * * * *